US010328305B1

(12) United States Patent
Maresh et al.

(10) Patent No.: US 10,328,305 B1
(45) Date of Patent: Jun. 25, 2019

(54) EXERCISE MACHINE

(71) Applicants: Joseph D Maresh, West Linn, OR (US); Kenneth W Stearns, Houston, TX (US)

(72) Inventors: Joseph D Maresh, West Linn, OR (US); Kenneth W Stearns, Houston, TX (US)

( * ) Notice: Subject to any disclaimer, the term of this patent is extended or adjusted under 35 U.S.C. 154(b) by 0 days.

(21) Appl. No.: 15/622,068

(22) Filed: Jun. 13, 2017

Related U.S. Application Data

(63) Continuation-in-part of application No. 15/615,825, filed on Jun. 6, 2017.

(60) Provisional application No. 62/392,879, filed on Jun. 13, 2016, provisional application No. 62/496,117, filed on Oct. 5, 2016, provisional application No. 62/392,617, filed on Jun. 6, 2016.

(51) Int. Cl.

| | |
|---|---|
| ***A63B 22/00*** | (2006.01) |
| ***A63B 23/04*** | (2006.01) |
| ***A63B 21/00*** | (2006.01) |
| ***A63B 22/06*** | (2006.01) |
| ***A63B 23/035*** | (2006.01) |

(52) U.S. Cl.

CPC ..... *A63B 23/0423* (2013.01); *A63B 21/154* (2013.01); *A63B 21/4034* (2015.10); *A63B 21/4035* (2015.10); *A63B 22/001* (2013.01); *A63B 22/0023* (2013.01); *A63B 22/0664* (2013.01); *A63B 23/03575* (2013.01); *A63B 2022/0676* (2013.01)

(58) Field of Classification Search

None

See application file for complete search history.

(56) References Cited

U.S. PATENT DOCUMENTS

| | | | | |
|---|---|---|---|---|
| 8,147,384 | B2 * | 4/2012 | Stearns | A63B 22/001 482/52 |
| 8,272,995 | B2 * | 9/2012 | Stearns | A63B 22/001 482/52 |
| 8,852,059 | B1 * | 10/2014 | Stearns | A63B 22/001 482/52 |
| 2002/0155926 | A1 * | 10/2002 | Lat | A63B 21/015 482/52 |
| 2003/0216222 | A1 * | 11/2003 | Kuo | A63B 22/0056 482/52 |
| 2005/0272562 | A1 * | 12/2005 | Alessandri | A63B 21/154 482/52 |
| 2006/0046902 | A1 * | 3/2006 | Chang | A63B 22/0664 482/52 |
| 2007/0298935 | A1 * | 12/2007 | Badarneh | A63B 22/001 482/52 |
| 2008/0146417 | A1 * | 6/2008 | Chang | A63B 22/0064 482/70 |

(Continued)

*Primary Examiner* — Stephen R Crow

(74) *Attorney, Agent, or Firm* — Nick A Nichols, Jr.

(57) ABSTRACT

In an exercise machine, foot platforms may travel in inclined circular paths to establish three dimensional operational characteristics. Platform support members may be rotationally synchronized by connected mechanical components such that they are maintained out of phase with each other by one half of a cycle or 180 degrees in counter rotational directions. Crank synchronization in an inclined plane during operation of the exercise machine may provide three-dimensional foot travel in vertical, lateral and longitudinal directions.

13 Claims, 16 Drawing Sheets

(56) References Cited

U.S. PATENT DOCUMENTS

| | | | | |
|---|---|---|---|---|
| 2009/0209395 | A1* | 8/2009 | Maresh | A63B 21/0051 482/52 |
| 2012/0004077 | A1* | 1/2012 | Chu | A63B 21/225 482/52 |
| 2016/0089562 | A1* | 3/2016 | Grossmann | A63B 21/4047 482/52 |

* cited by examiner

EXERCISE MACHINE

CROSS-REFERENCE TO RELATED APPLICATION

This application claims the benefit of U.S. Provisional Application Ser. No. 62/392,879, filed Jun. 13, 2016, and U.S. Provisional Application Ser. No. 62/496,117, filed Oct. 15, 2016, and is a continuation-in-part of U.S. Non-Provisional application Ser. No. 15/615,825, filed Jun. 6, 2017, which claims the benefit of U.S. Provisional Application Ser. No. 62/392,617, filed Jun. 6, 2016, which applications are incorporated herein by reference in their entirety.

BACKGROUND

The present invention relates to an exercise machine, more particularly, a stationary exercise machine which provides vertical, lateral and longitudinal foot path motion to exercise lower body muscles.

Three popular categories of exercise machines known to exercise various muscle groups in the human body include bicycle machines, stair steppers, and skiing machines. These machines have been successful because they offer an effective form of an aerobic, low impact exercise.

Bicycle machines provide resistance to leg motion by causing two foot petals to resistively travel along a circular path, mutually in the same direction, about a coaxial, horizontal axis of rotation, while maintaining the pedals diametrically opposite and with constant lateral distance between them.

Stair steppers provide resistance to leg motion such that work is performed during the unbending (or straightening) of each leg as two pedals or foot platforms are continuously and alternatively stepped upon and released.

Skiing machines offer resistance to leg motion by allowing two foot platforms to alternately travel rearward with resistance and forward with minimal resistance in a linear side by side manner. During use, dependent upon the specific machine design, the two foot platforms may have to be continuously coordinated and synchronized by the user to be out of phase with each other by half of a cycle.

SUMMARY

In an exercise machine, foot platform support members, each with their own distinct axis of rotation, may include a foot platform rotatably installed at an outer end. The foot platforms may travel in inclined circular paths to establish the three dimensional operational characteristics. The platform support members may be rotationally synchronized by connected mechanical components such that they are maintained out of phase with each other by one half of a cycle or 180 degrees in counter rotational directions. Inertial characteristics during operation, may be provided by a mechanical flywheel, with its respective driven pulley, installed remote from the platform support members, and belt or chain driven by a drive pulley secured at an inner end to one of the rotatable platform support members. Crank synchronization in an inclined plane at angle β during operation of the exercise machine may provide three-dimensional foot travel in vertical, lateral and longitudinal directions.

BRIEF DESCRIPTION OF THE DRAWINGS

So that the manner in which the above recited features, advantages and objects of the present invention are attained can be understood in detail, a more particular description of the invention briefly summarized above, may be had by reference to the embodiments thereof which are illustrated in the appended drawings.

It is noted, however, that the appended drawings illustrate only typical embodiments of this invention and are therefore not to be considered limiting of its scope, for the invention may admit to other equally effective embodiments.

DETAILED DESCRIPTION

Figure 1:
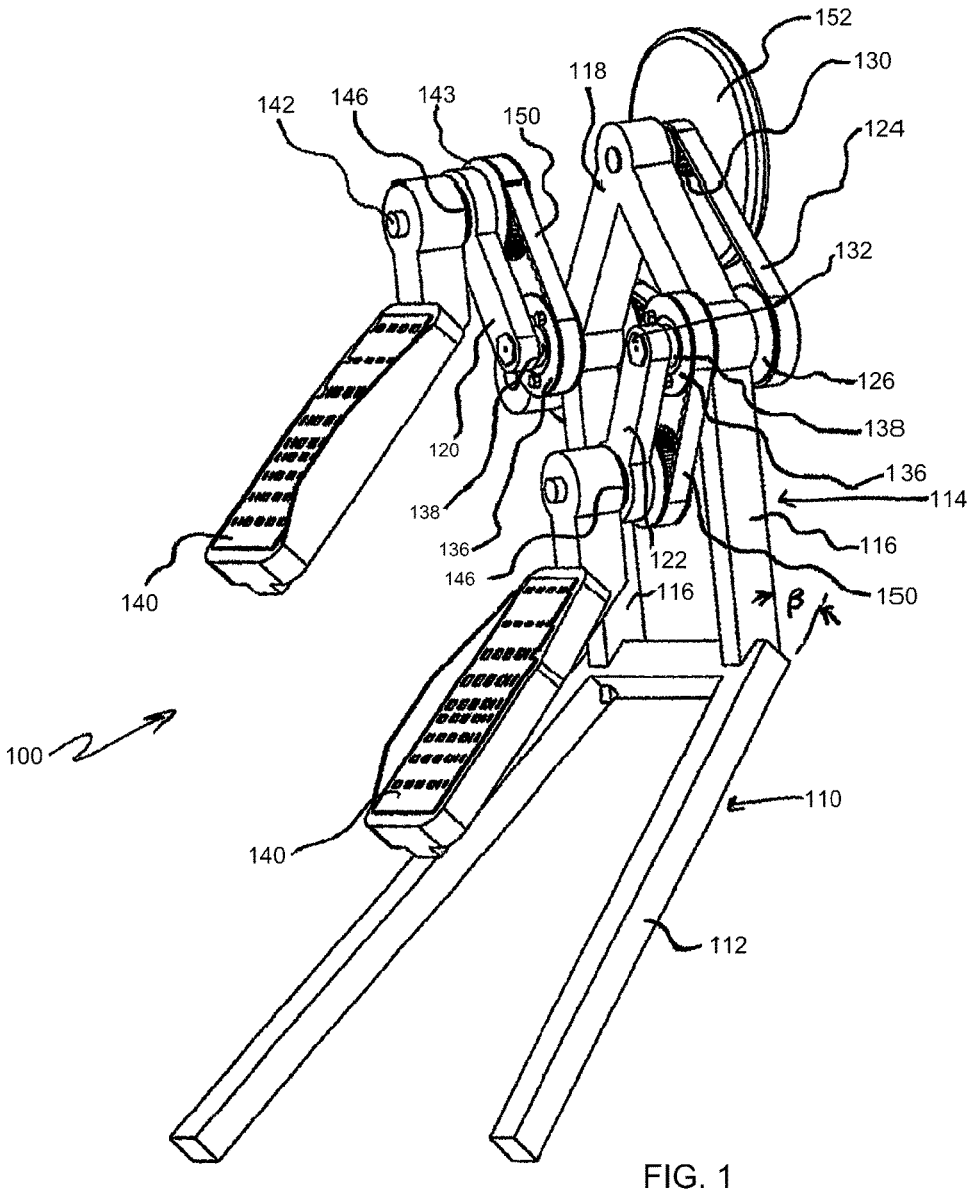
FIG. 1 is a perspective view of an exercise machine.
Figure 2:
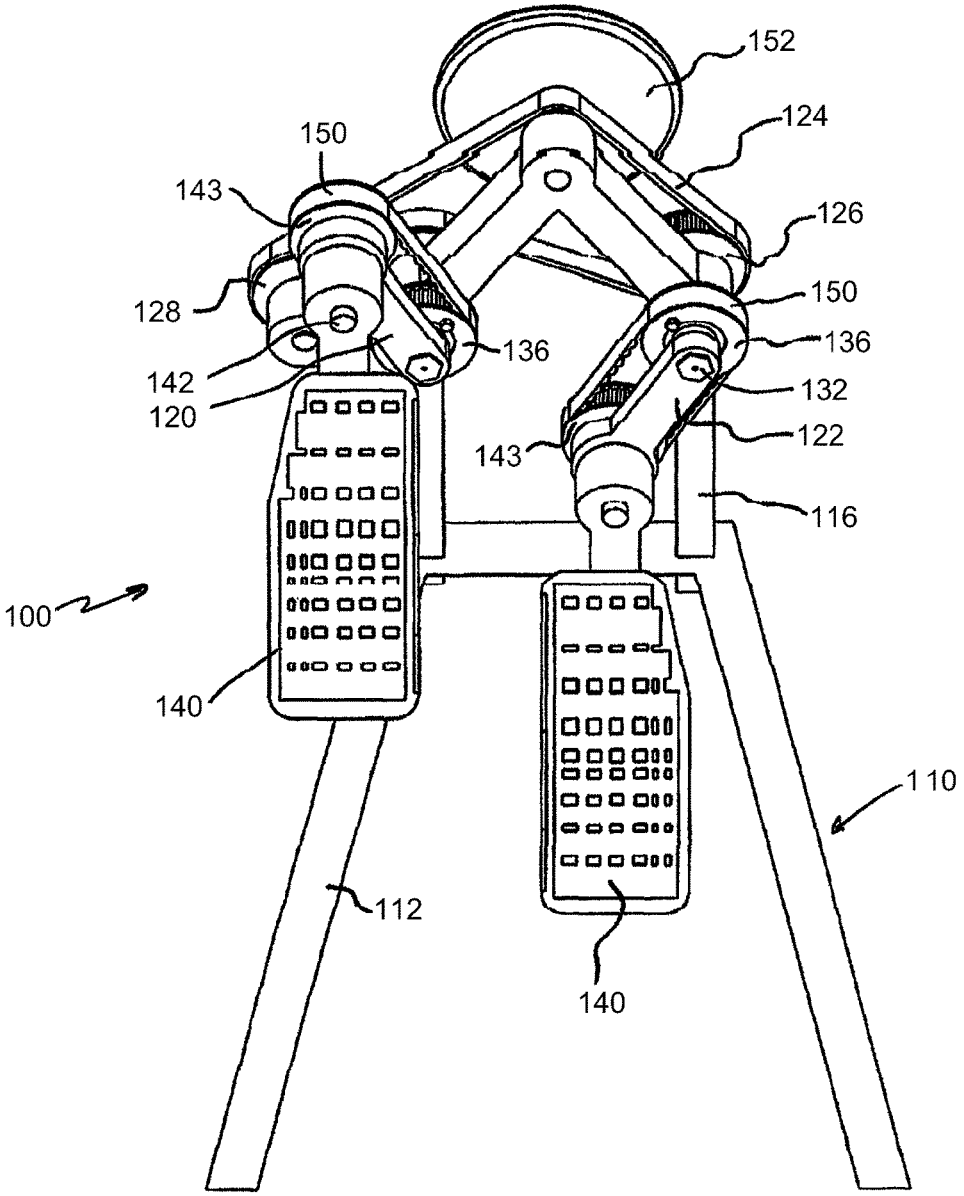
FIG. 2 is a rear partial perspective view of the exercise machine shown in FIG. 1.
Figure 4:
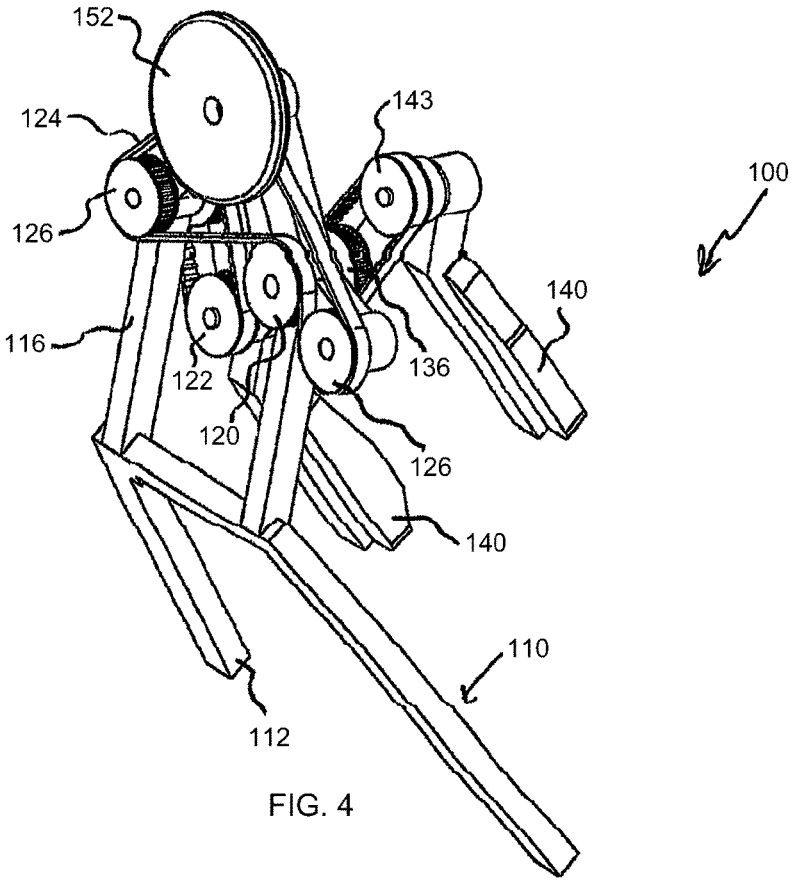
FIG. 4 is a front perspective view of the exercise machine shown in FIG. 1.
Figure 3:
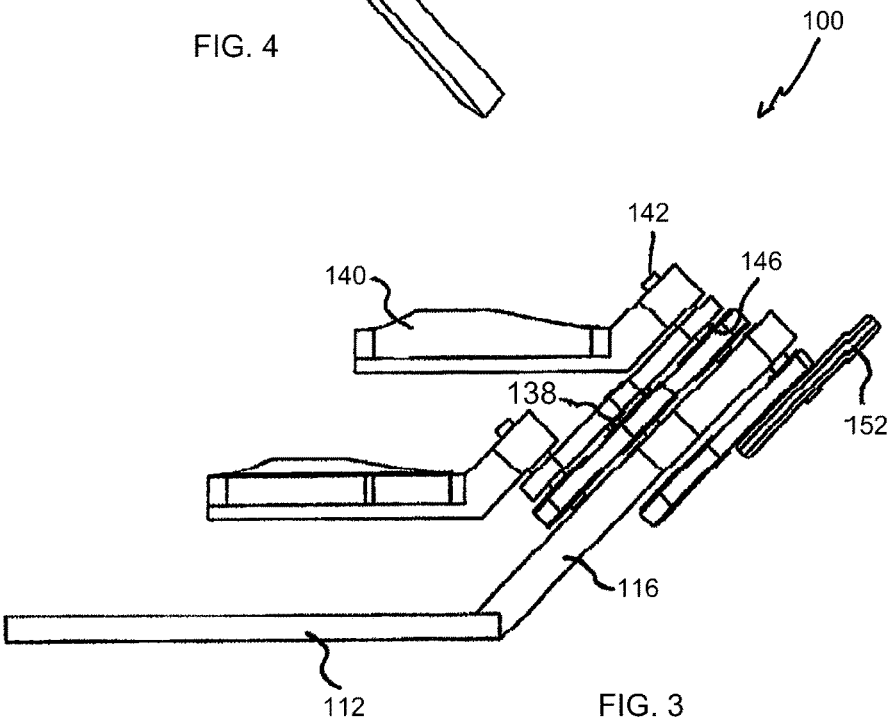
FIG. 3 is a side view of the exercise machine shown in FIG. 1.

Referring first to FIG. 1, an exercise machine in generally identified by the reference numeral 100. The exercise machine 100 may include a frame 110 configured to rest on a substantially flat surface, such as but without limitation, a floor surface. The frame 110 may include a base 112 and a stanchion 114 extending angularly upward and forward from proximate a forward end of the base 112. The stanchion 114 may be inclined in a forward direction at an angle β relative to a horizontal plane defined by the base 112. The angle β may, for example but without limitation, may be about sixty (60°) degrees.

The stanchion 114 may include a pair of stanchion leg members 116 spaced apart from one another. A frame bridge member 118 may extend across the space separating the stanchion leg members 116. Opposite distal ends of the stanchion bridge member 118 may be fixedly secured to the upper distal ends of the stanchion leg members 116. Alternatively, the stanchion 114 may be fabricated as a single unitary frame member fixedly secured proximate the forward end of the base 112.

The exercise machine 100 may include a stationary handle bar (not shown in the drawings) for grasping by an operator while exercising. It may be noted that a stationary handle bar may be replaced with handles which move under resistance, if an upper body workout is also desired. Such handles may for example pivot about an axis perpendicular to the side of the exercise machine 100, and be bent such that the hand grips are located at a comfortable position to operate. Because various designs of upper body workout handles, poles, or cranks or levers are incorporated upon many different categories of exercise machines, the potential for including any one of them upon the exercise machine 100 is considered obvious.

Left and right cranks 120, 122 may be rotatably secured to the stanchion 114. A flywheel timing belt 124 may engage a series of timing pulleys 126, 128 and 130 in a circuitous manner so that counter rotation of the cranks 120, 122 may be established in a manner known in the art.

Left and right cranks 120, 122 may be rotatably mounted at proximate the upper distal ends of respective stanchion leg members 116 and rigidly secured to respective crank shafts 132. The crank shafts 132 may extend through respective boreholes 133 in the stanchion leg members 116. The crank shafts 132 may be keyed to respective timing pulleys 126 by a key and slot 134 connection so that the cranks shafts 120, 122 and respective timing pulleys 126 rotate together.

The crank shafts 132 may extend through respective fixed timing pulleys 136 disposed between the cranks 120, 122 and stanchion leg members 116. The crank shafts 132 may be rotatably secured to respective fixed timing pulleys 136 by radial and thrust bearings 138. The fixed timing pulleys 136, radial and thrust bearings 138 and boreholes 133 may be concentric to one another.

Figure 5:
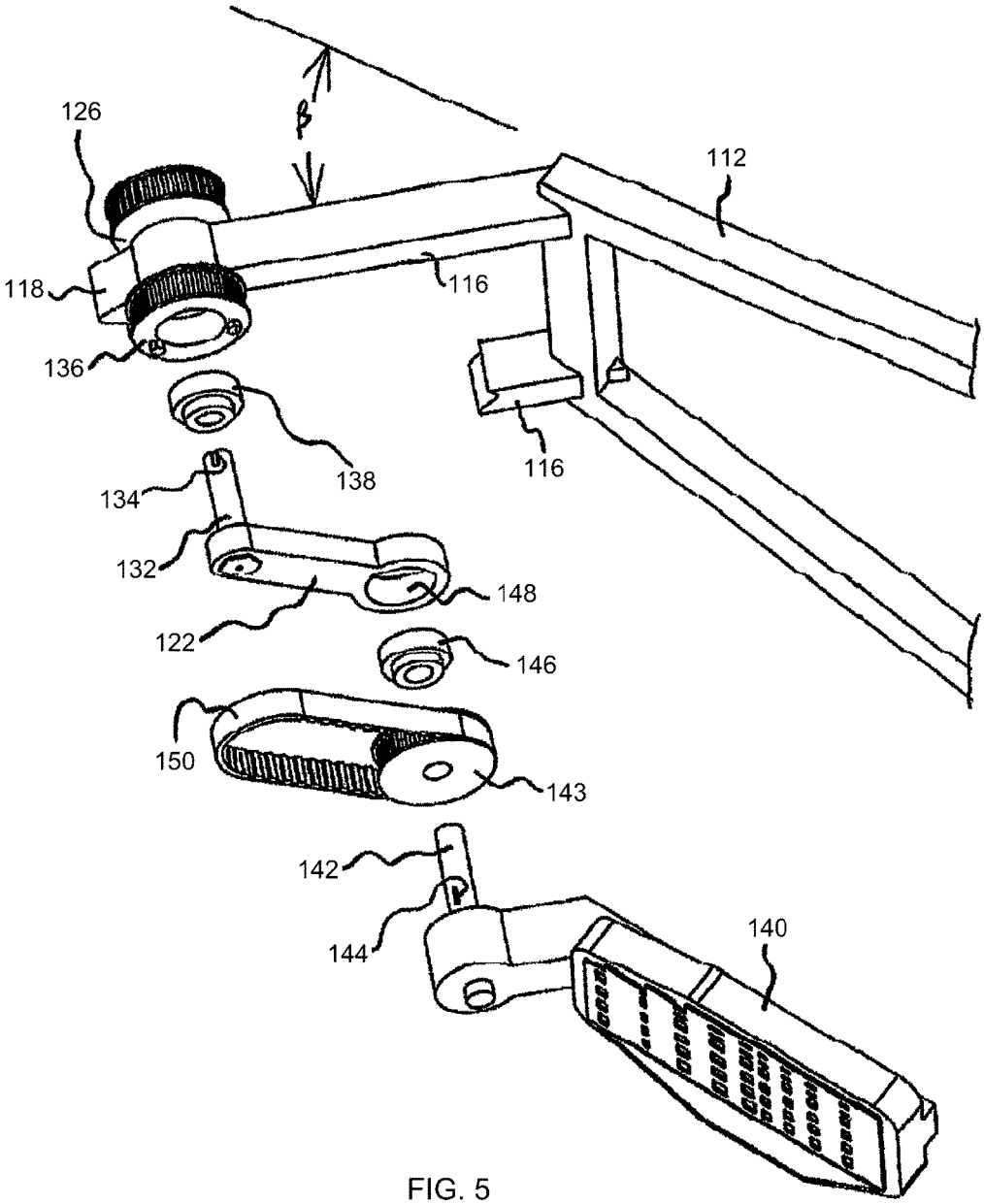
FIG. 5 is an exploded partial perspective view of the exercise machine shown in FIG. 1.

The exercise machine 100 may include foot platforms 140 supported by respective cranks 120, 122. Foot platform shafts 142 may rigidly secure the foot platforms 140 to respective timing pulleys 143 by a key and slot 144 connection. The foot platform shafts 142 may be rotatably secured to respective cranks 120, 122 by radial thrust bearings 146 concentrically received in a bore 148 of respective cranks 120, 122, best shown in FIG. 5.

Referring again to FIG. 1, synchronization timing belts 150 may engage respective timing pulleys 143 and fixed timing pulleys 136. As timing pulleys 143 orbit fixed timing pulleys 136 in an inclined plane while engaging orbital synchronization timing belts 150 the orientation of the foot platforms 140 remains constant while the foot platforms 140 move in three dimensions. Timing belts 124, 150 and timing pulleys 126, 130, 136, 143 may cooperatively interconnect to define a synchronization linkage interconnecting the left and right cranks 120, 122 for moving the left and right foot platforms 140 in inclined paths defining three-dimensional foot travel. Inertia of the exercise machine 100 due to rotation of the flywheel 152 may be provided while left and right timing pulleys 126 drive timing belt 124, thereby causing rotation of idler pulley 128 and flywheel pinion pulley 130. It may be observed that crank synchronization lies in an inclined plane at angle β during operation of the exercise machine 100 while providing three-dimensional foot travel in vertical, lateral and longitudinal directions, more fully described in U.S. Pat. No. 5,595,554 which is incorporated herein by reference in its entirety.

Generally, the three spatial dimensions that an operator may experience include, a first spatial dimension corresponding to the forward and back (longitudinal) motion of the foot pedals traveling along their inclined circular paths. The magnitude of the first dimension is inversely proportional to the angle β to which the plane defining the circular path of the foot pedals has been inclined from horizontal. The second spatial dimension corresponds to the up and down (vertical) motion of the foot platforms traveling along their inclined circular paths. The magnitude of the second dimension is directly proportional to the inclination angle β of the circular path plane, and as follows, would be zero if the path is level. The third spatial dimension corresponds to the side to side (transverse) motion of the foot platforms traveling along their circular path, and, because the path plane has not been inclined transversely, the magnitude of this third dimension is not a function of the degree to which the inclined path of the foot pedals traveling along their circular paths has been inclined.

Figure 6:
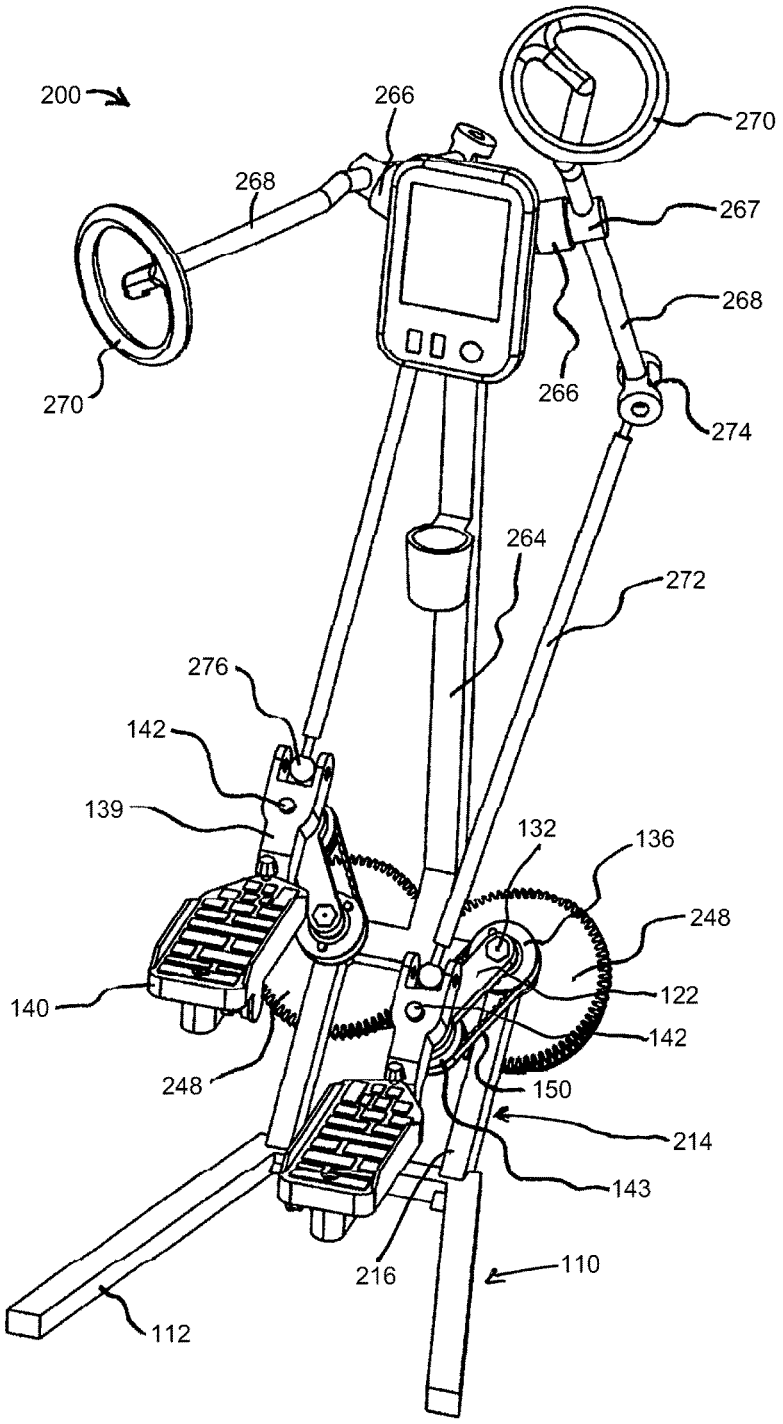
FIG. 6 is a perspective view of a second embodiment of an exercise machine.

Referring next to FIG. 6, a second embodiment of an exercise machine is generally identified by the reference numeral 200. As will be noted by the use of common reference numerals, the exercise machine 200 is similar to the exercise machine 100 described above. The exercise machine 200 may include a frame 110 configured to rest on a substantially flat surface, such as but without limitation, a floor surface. The frame 110 may include a base 112 and a stanchion 214 extending angularly upward and forward from proximate a forward end of the base 112. The stanchion 214 may be inclined in a forward direction at an angle β relative to a horizontal plane defined by the base 112. The angle β may be, for example but without limitation, about sixty (60°) degrees.

The stanchion 214 may include a pair of stanchion leg members 216 spaced apart from one another. A frame bridge member 218 may extend across the space separating the stanchion leg members 216. Opposite distal ends of the stanchion bridge member 218 may be fixedly secured to the upper distal ends of the stanchion leg members 216. Alternatively, the stanchion 214 may be fabricated as a single unitary frame member fixedly secured proximate the forward end of the base 112.

Left and right cranks 120, 122 may be rotatably secured to the stanchion 214 proximate the upper distal ends of respective stanchion leg members 216 and rigidly secured to respective crank shafts 132. The crank shafts 132 may extend through respective boreholes in the stanchion leg members 216. The crank shafts 132 may be keyed to respective timing pulleys 126 by a key and slot connection so that the cranks shafts 120, 122 and timing pulleys 126 rotate together. The crank shafts 132 may extend through respective fixed timing pulleys 136 disposed between the cranks 120, 122 and stanchion leg members 216. The crank shafts 132 may be rotatably secured to respective fixed timing pulleys 136 by radial and thrust bearings 138. The fixed timing pulleys 136 and radial and thrust bearings 138 may be concentric to one another.

The exercise machine 200 may include foot support members 139 supported by respective cranks 120, 122. Shafts 142 may rigidly secure the foot support members 139 to respective timing pulleys 143 by a key and slot connection. The shafts 142 may be rotatably secured to respective cranks 120, 122 by radial and thrust bearings 146 concentrically received in a bore 148 of respective cranks 120, 122.

Left and right inclined counter rotating gears 248 may be rotatably secured to the stanchion 214 proximate the upper distal ends of respective stanchion leg members 216 and rigidly secured to respective crank shafts 132 by a key and slot connection or other means known in the art. Fixed timing pulleys 136 and respective timing pulleys 143 may be engaged by a synchronous belt 150, thereby causing the orientation of the foot platforms 140 to remain constant as the foot platforms 140 move in a non-vertical plane.

Figure 7:
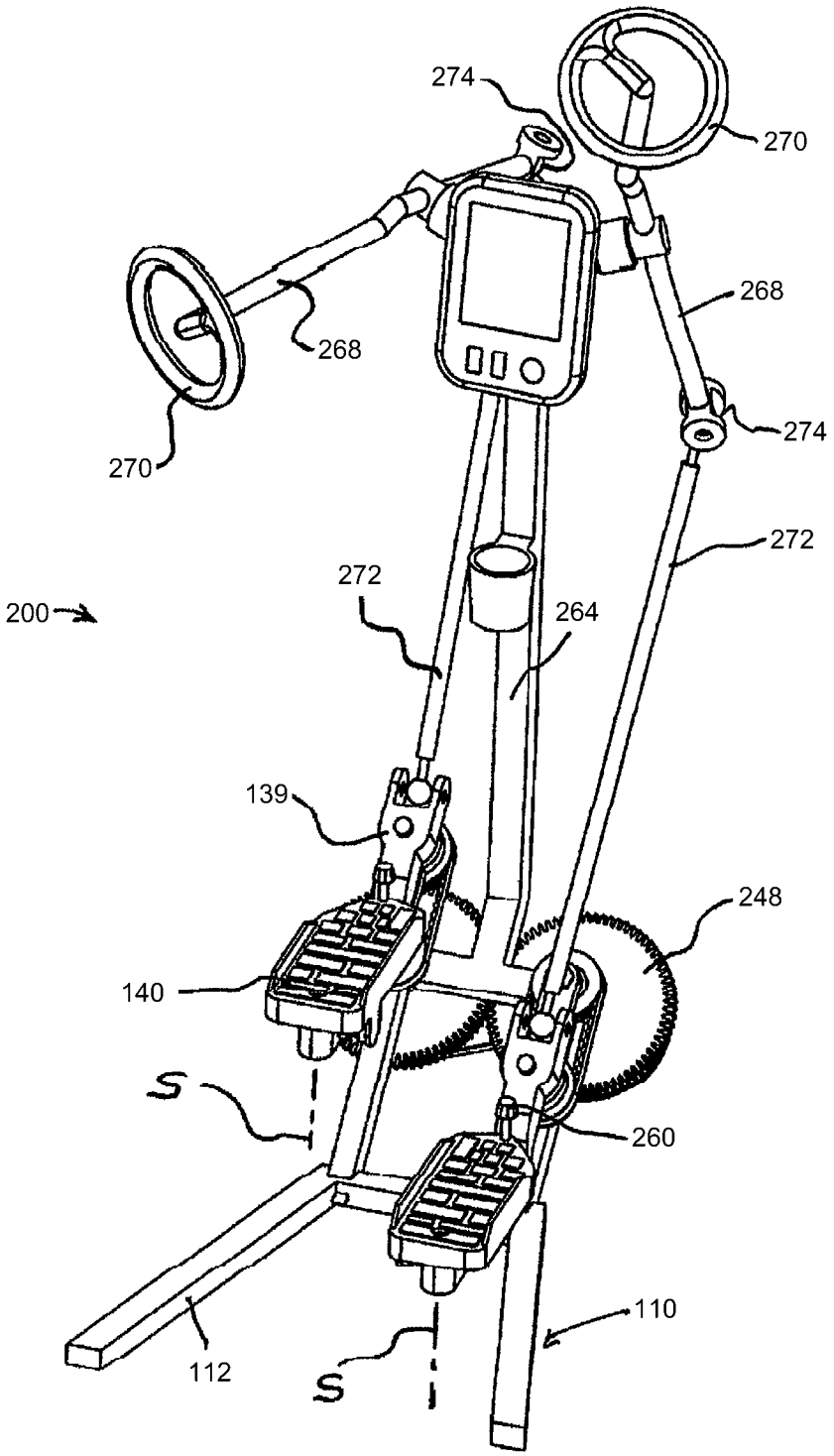
FIG. 7 is another perspective view of the exercise machine shown in FIG. 6.
Figure 8:
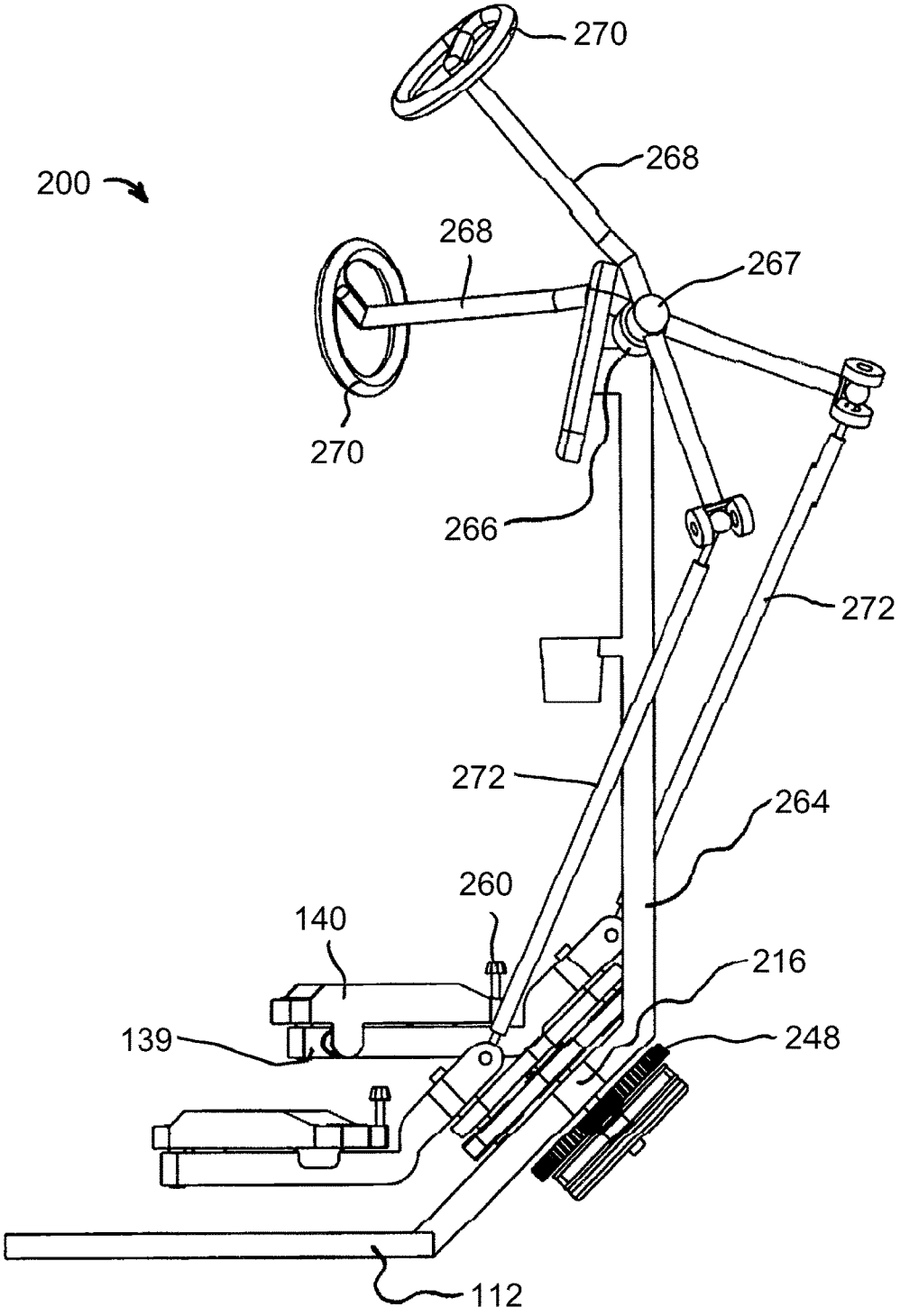
FIG. 8 is a partial perspective side view of the exercise machine shown in FIG. 6.
Figure 9:
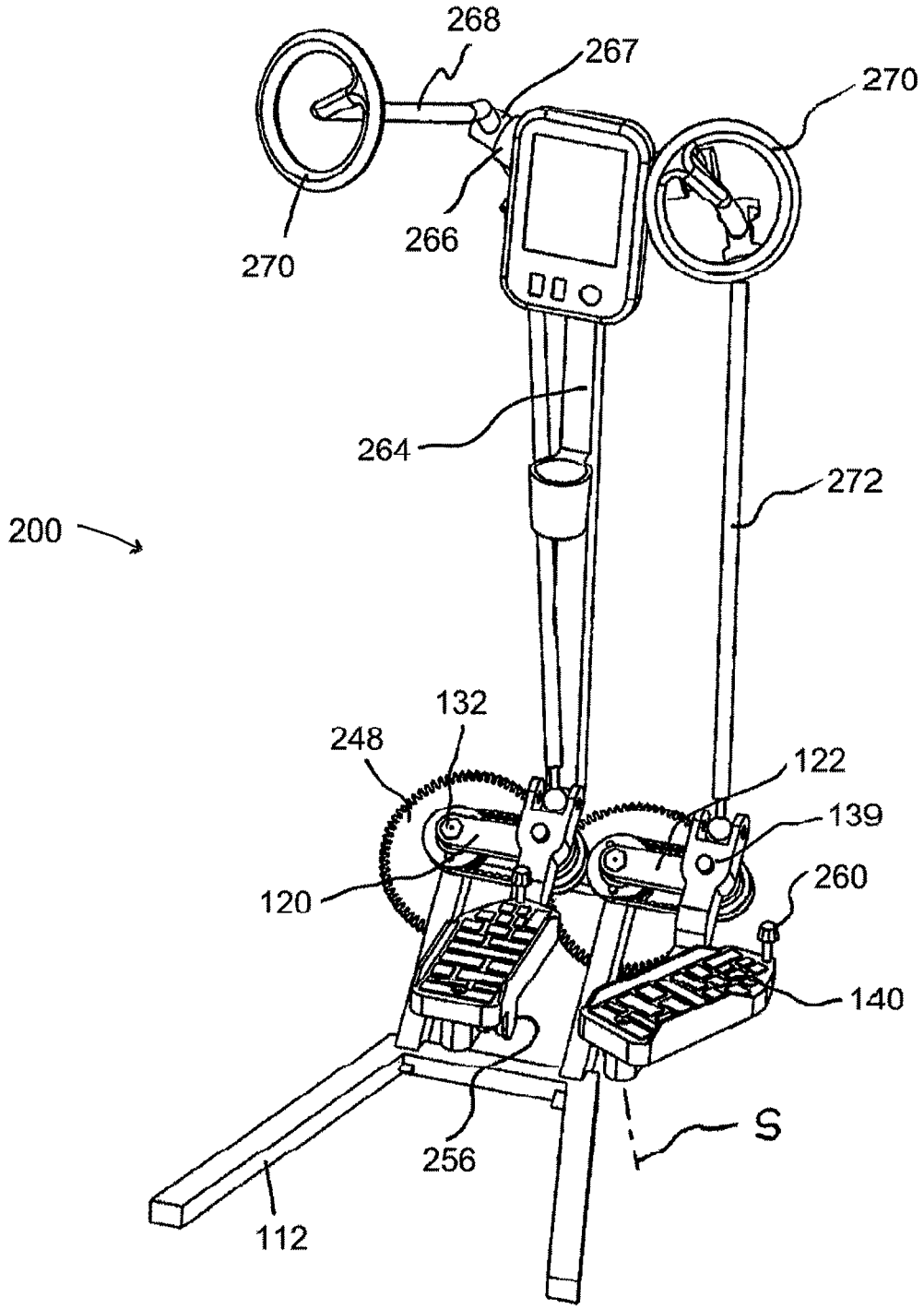
FIG. 9 is a partial perspective front view of the exercise machine shown in FIG. 6.
Figure 10A:
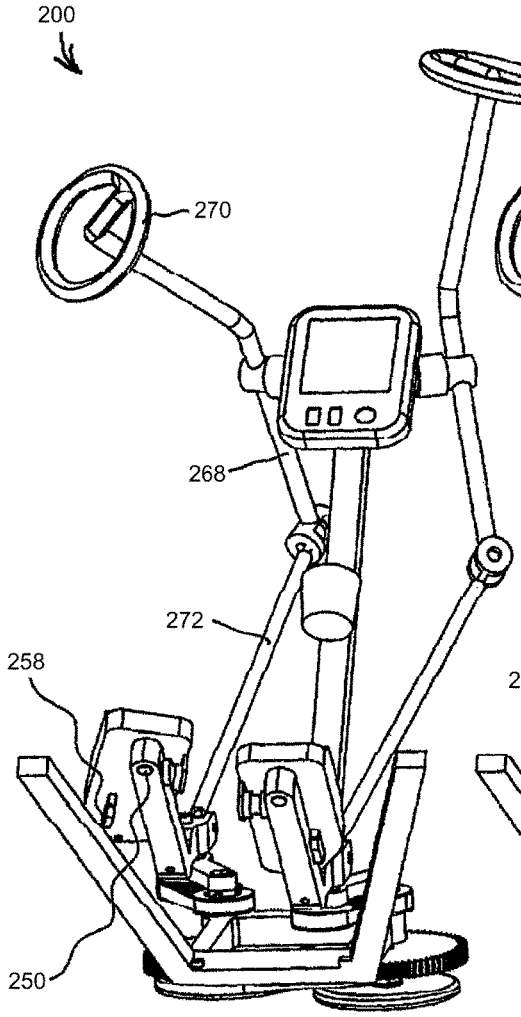
FIG. 10A is a partial perspective bottom view of the exercise machine shown in FIG. 6.
Figure 10B:
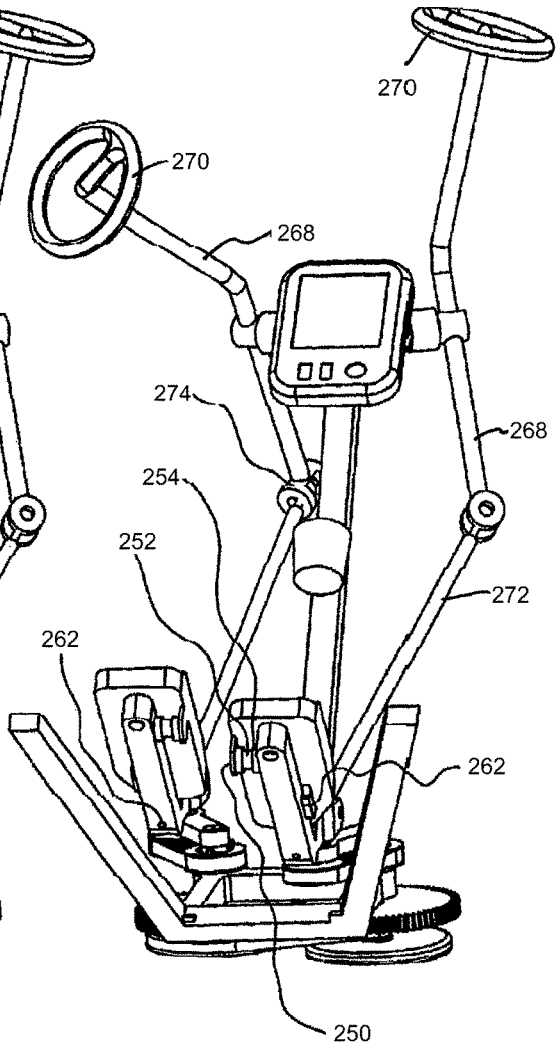
FIG. 10B is another partial perspective bottom view of the exercise machine shown in FIG. 6.

Foot platforms 140 may be rotatably connected to respective foot support members 139 about a pivot shaft 250 defining a generally vertical axis S, shown in FIG. 7. The foot platforms 140 may be biased toward a straight or in-line orientation over respective foot support members 139, as shown in FIG. 7. For example, but without limitation, the foot platforms 140 may be biased to a straight orientation by a urethane spring 252 captured between a spring seat 254 fixedly secured to the foot support members 139 and a foot platform spring seat 256, more clearly shown in FIGS. 10A and 10B. Alternative spring designs, such as but without limitation, coiled compression or extension springs may be employed to bias the foot platforms 140 to the straight orientation. The spring 252 applies an outward force that tends to rotate the foot platforms 140 about pivot shaft 250. A stop member 258 extending downward from the bottom of the foot platforms 140 is forced into contact with the foot support members 139, thereby positioning the foot platforms 140 in a straight orientation, as shown in FIG. 10B.

During use, movement of the forward region of a foot platform 140 laterally outward generally about vertical pivot shaft 250 compresses the biasing spring 252. Typically, a user will push downward while pushing the toe portion of the user's foot laterally outward in a manner typically experienced with "toe out pushing" while skating and the like, although those skilled in the art will recognize that an alternate arrangement may be provided such that the foot platform 140 may be biased in any direction and/or where the foot platform 140 may be rotatably secured to forward region of the foot platform 140 such that "heel in or out" movement may be accomplished. A lock pin 260 mounted proximate a forward end of the foot platforms 140 may be pushed into a receiving hole 262 in the foot support members 139 to prevent lateral movement of the foot platforms 140.

Referring again to FIG. 6, the exercise machine 200 may include a generally vertical stanchion extension 264. Left and right frame journals 266 extend outwardly from proximate the upper end of the stanchion extension 246. Left and right handlebars 268 may be rotatably secured to the frame journals 266 at bearing shaft 267. Hand grips 270 may be rigidly secured to the upper distal ends of the handlebars 268.

Left and right handlebar drives 272 may be secured to respective left and right handlebars 268 at ball joint bearings 274. The lower distal ends of the left and right handlebar drivers 272 may be secured to forward distal ends of the foot support members 139 at ball joint bearings 276. The linkage arrangement of the handlebars 268 and the handlebar drivers 272 between the frame 110 and the foot support members 139 links movement of the handlebars 268 and foot support members 139 in closed paths relative to the frame 110 in response to forces a user applies to the handlebars 268 and foot support members 139 for exercising the upper and lower body of a user.

Figure 11:
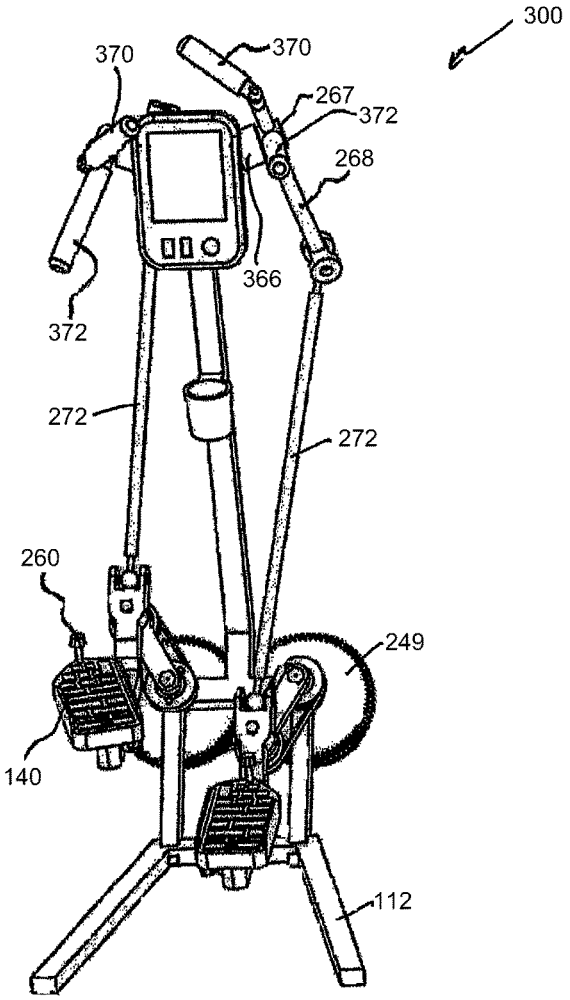
FIG. 11 is perspective of a third embodiment of an exercise machine.
Figure 12:
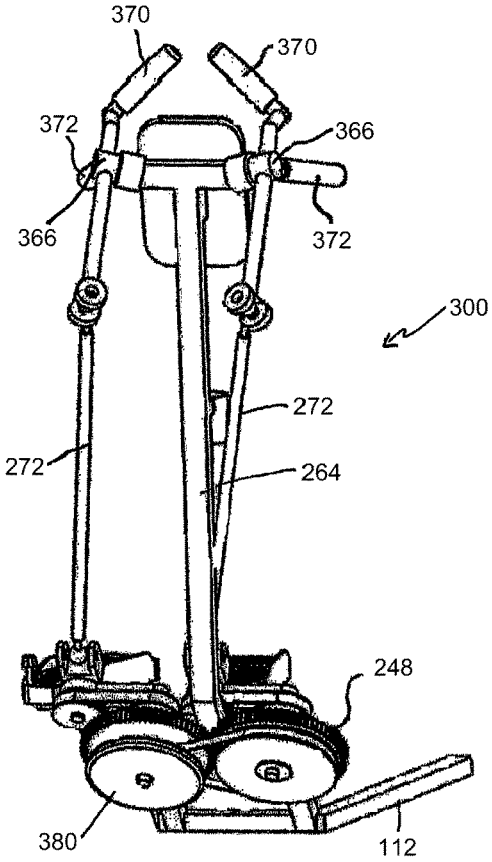
FIG. 12 is another perspective view of the exercise machine shown in FIG. 11

Referring now to FIGS. 11 and 12, a third embodiment of an exercise machine is generally identified by the reference numeral 300. The exercise machine 300 is similar to the exercise machine 200 described in greater detail above with the exception that the exercise machine 300 may include frame journals 366 directed upward and forward. First hand grips 370 may be rigidly secure to the upper distal ends of the handlebars 268. Second hand grips 372 may be fixedly secured to the handlebars 268 at bearing shaft 267 to provide the user with different hand orientations while exercising. A flywheel 380 may be rigidly secured by a small pinion pulley concentric with a first gear 248 and independently rotatably secured and driven by a relatively large pulley rigidly secured with a second gear 248.

Figure 13:
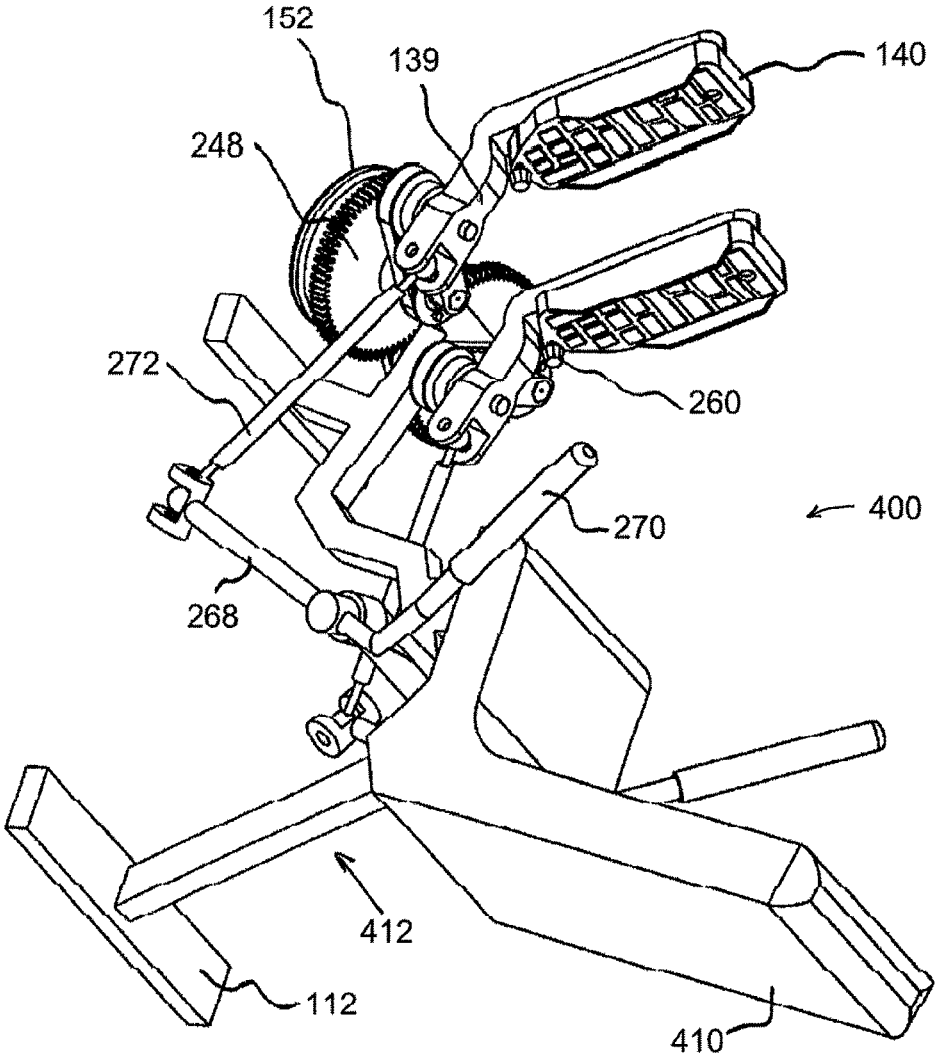
FIG. 13 is a perspective view of a fourth embodiment of an exercise machine.
Figure 14:
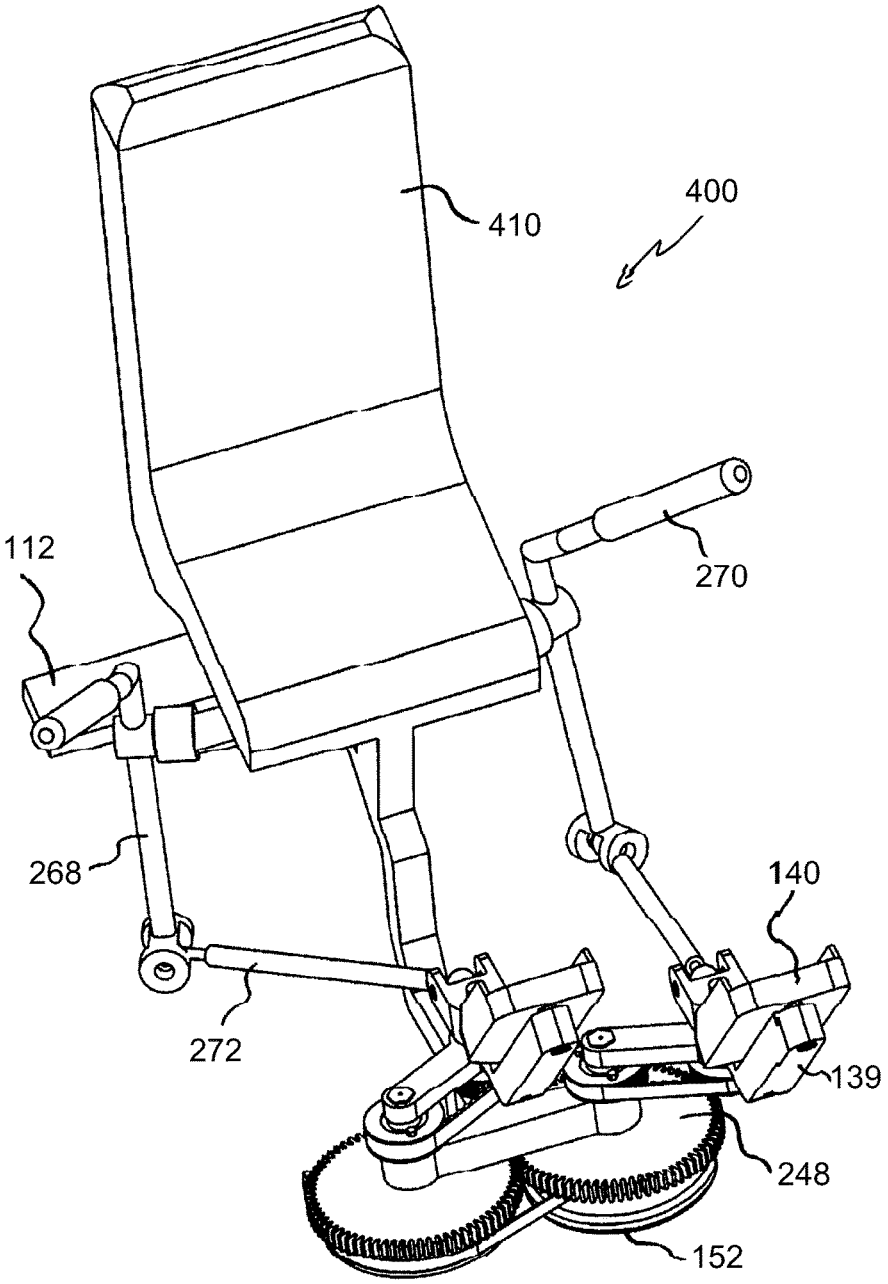
FIG. 14 is another perspective of the exercise machine shown in FIG. 13.
Figure 15:
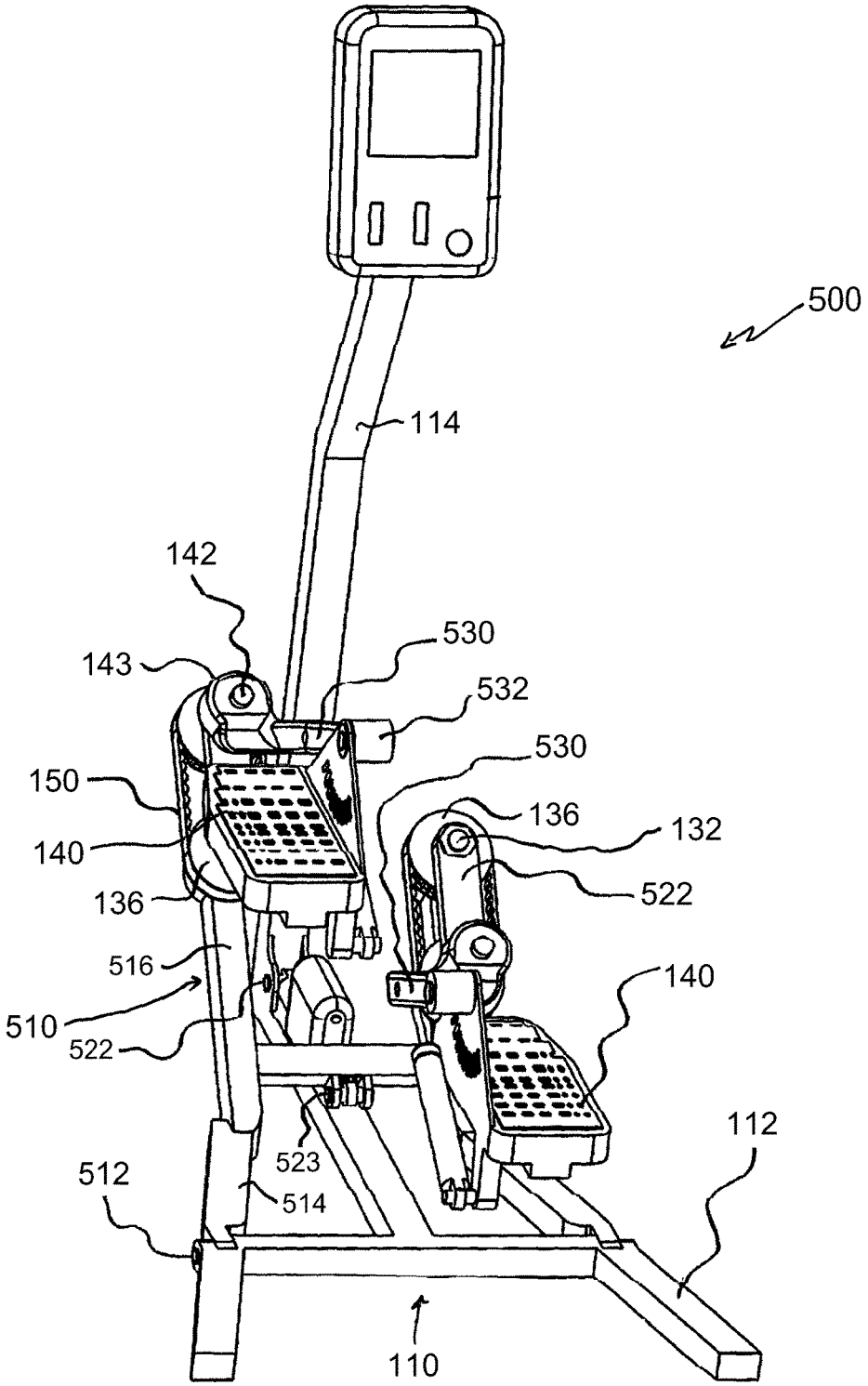
FIG. 15 is a perspective of a fifth embodiment of an exercise machine.
Figure 16:
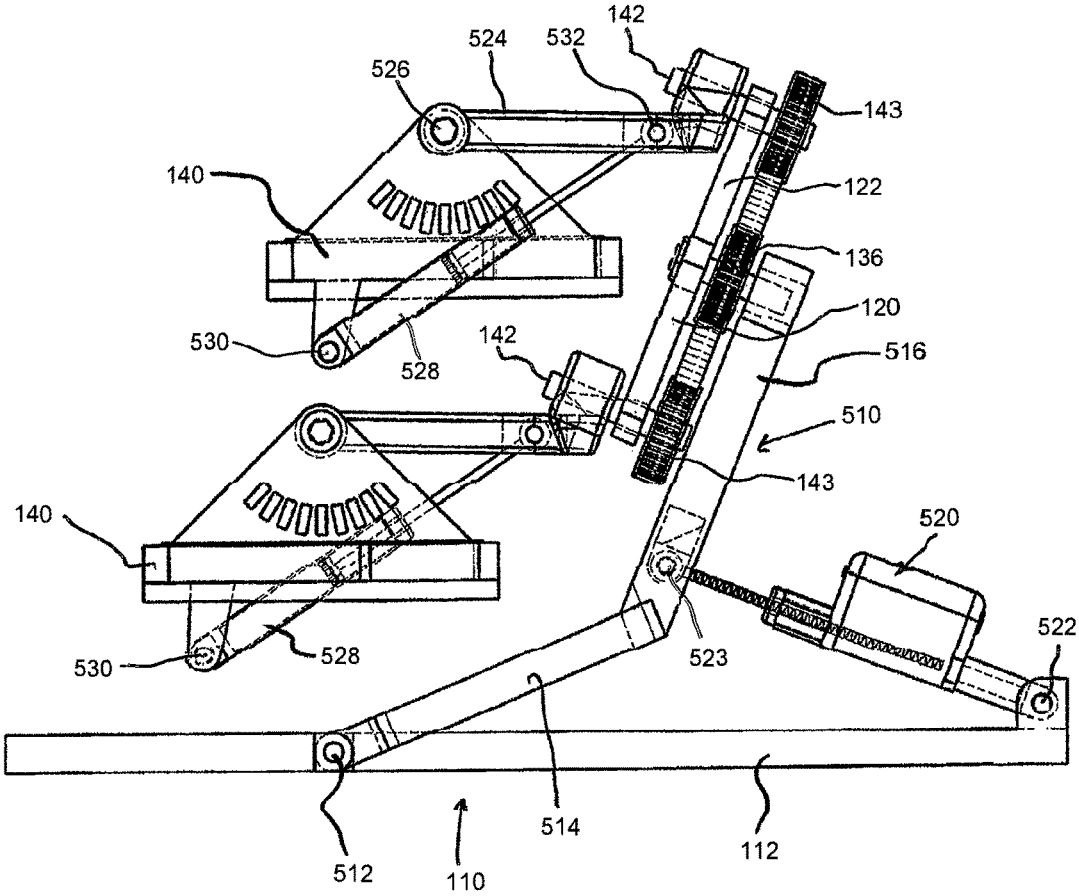
FIG. 16 is a partial side view of the exercise machine shown in FIG. 15.
Figure 17A:
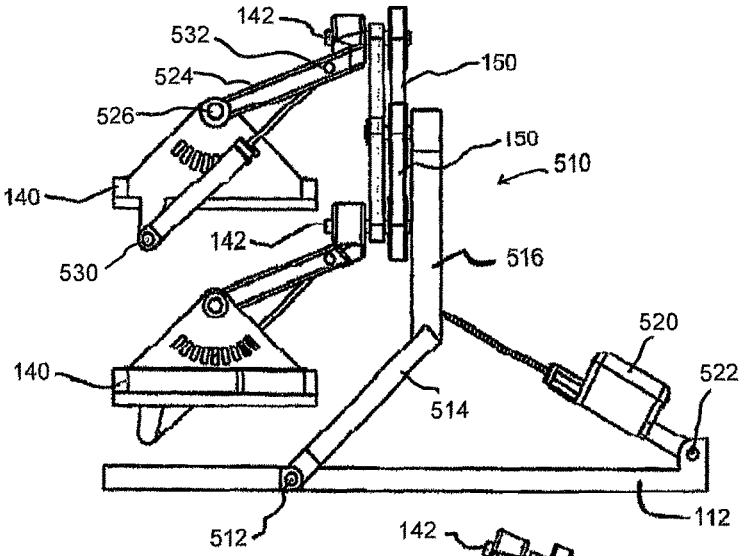
FIGS. 17A, 17B and 17C are partial side view of the exercise machine shown in FIG. 15 depicting the exercise machine in various inclined positions.
Figure 17B:
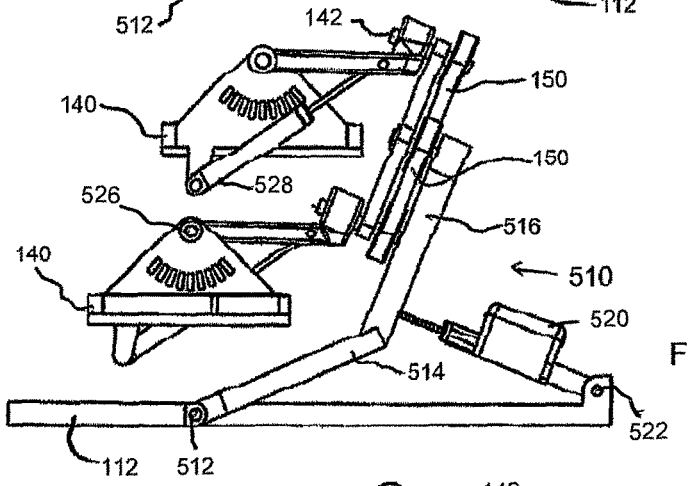
Figure 17C:
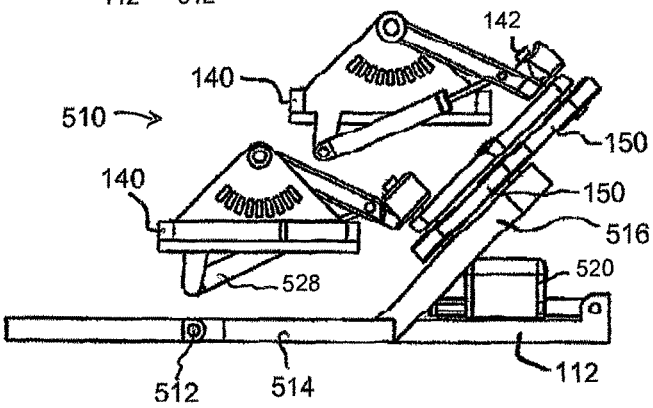
Figure 18:
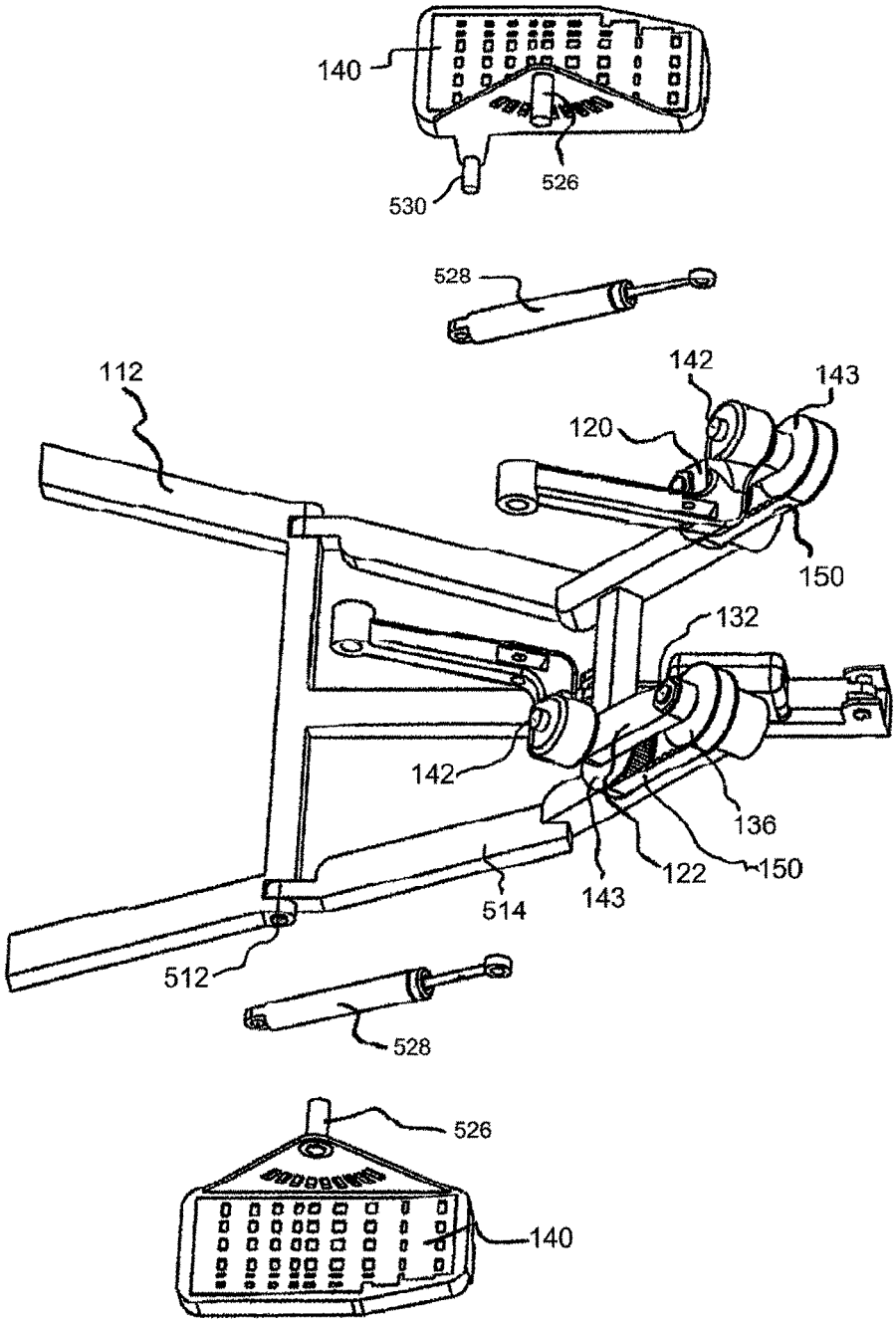
FIG. 18 is an exploded partial perspective of the exercise machine shown in FIG. 15.

Referring now to FIGS. 13 and 14, a fourth embodiment of an exercise machine is generally identified by the reference numeral 400. The exercise machine 400 may be defined as a recumbent exercise machine which generally includes the elements of the aforementioned embodiments as noted by the use of common reference numerals. The exercise machine 400 may include foot platforms 140 that move in a non-vertical plane inclined at an angle β while a user is seated in a seat 410 and the user's feet may move in vertical, longitudinal and lateral directions. The frame 412 is stationary configured to rest upon a flat surface, such as but without limitation a floor. Inclined and engaged counter rotating gears 248 maintain the foot platforms 140 one hundred eighty (180°) degrees out of phase between left and right foot platforms 140. An inclined flywheel 152 may provide inertia for the exercise machine 400. A first distal end of handlebar drivers 272 may be spherically connected to foot support members 139, and a second distal end of the handlebar drivers 272 may be spherically connected to handlebars 268 by ball joints and the like. Handlebars 268 may be rotatably secured to the frame 412 in such a manner oppositional movement occurs between the user's arms versus the user's legs at a given side of the user's body.

Referring now to FIGS. 15-18, a fifth embodiment of an exercise machine is generally identified by the reference numeral 500. The exercise machine is similar to the exercise machines described above, as may be observed by the use of common reference numerals, with the exception that inclination of the foot path of the exercise machine 500 may be adjusted from a generally vertical foot path to a foot path that may be inclined at an angle of about up to forty-five (45°) degrees. The exercise machine 500 may include a frame 110 configured to rest on a substantially flat surface, such as but without limitation, a floor surface. The frame 110 may include a base 112 and a stanchion 114 extending upwardly from proximate a forward end of the base 112. A subframe 510 may be rotatably connected to the base 112 at pivot pins 512. The subframe 510 may include a lower portion 514 and an upper portion 516 extending angularly upward and forward from the lower portion 514. An actuator 520 is rotatably secured to the base 112 at journal 522 and an opposite end of the actuator 520 is rotatably secured to the upper portion 516 of the subframe 510 at journal 523.

The foot platform 140 may hang from a distal end of the foot support member 524. Due to gravity, the foot platform 140 generally remains level front to rear because pivot shaft 526, which connects the foot platform 140 to the foot support member 524, is oriented generally above a user's foot path. The front to rear or transverse orientation of the foot platforms 140 may be further maintained by low velocity rate dampers 528 connected to the foot platforms 140 at a pivot shaft 530 and to the foot support member 524 at a pivot shaft 532. Typically, the dampers 528 may cause change in the front to back orientation of the foot platforms 140 of about one or two degrees per second, corresponding to a change in the angular incline of the subframe 510 of about forty-five (45°) degrees over a period of 30 seconds operation of the actuator 520, thereby adjusting a generally vertical foot path to a foot path that may be inclined at an angle of about up to forty-five (45°) degrees.

While a preferred embodiment of the invention has been shown and described, other and further embodiments of the invention may be devised without departing from the basic scope thereof, and the scope thereof is determined by the claims which follow.

The invention claimed is:

1. An exercise apparatus, comprising:

a) a frame configured to rest on a flat surface, said frame including a base and a stanchion extending angularly upward from proximate a forward end of said base;

b) a left crank rotatably mounted on said frame for rotation about a left crank axis;

c) a right crank rotatably mounted on said frame for rotation about a right crank axis, wherein said left crank axis and said right crank axis are spaced apart from one another;

d) a left foot support member rotatably connected to said left crank, and a right foot support member rotatably connected to said right crank; and e) synchronization linkage movably interconnecting said left crank and said right crank in a manner to move said left foot platform and said right foot platform in respective inclined circular paths defining three-dimensional foot travel.

2. The apparatus of claim 1 wherein three-dimensional foot travel includes a vertical dimension, a lateral dimension and a longitudinal dimension.

3. The apparatus of claim 1 including first radial and thrust bearings connecting said left foot support member and said right foot member to respective said left crank and said right crank.

4. The apparatus of claim 3 including second radial thrust bearings connecting respective said left crank and said right crank to said frame.

5. The apparatus of claim 1 wherein said stanchion extends upward and forward at angle of about 60 degrees from a horizontal plane defined by said base of said frame.

6. The apparatus of claim 1 wherein said synchronization linkage includes a timing belt interconnecting said left crank and said left foot support member and said right crank and said right foot support member.

7. The apparatus of claim 1 wherein said synchronization linkage maintains said left foot support member and said right foot support member out of phase with each other by one half of a cycle or 180 degrees in counter rotational directions.

8. The apparatus of claim 1 wherein said synchronization linkage includes a flywheel timing belt in circuitous engagement with a series of timing pulleys for counter rotating said left crank and said right crank.

9. The apparatus of claim 1 wherein said synchronization linkage maintains said left foot support member and said right foot support member at a constant orientation while traveling in three dimensions.

10. The apparatus of claim 1 including a left foot support platform and a right foot support platform pivotally connected on respective said left foot support member and said right foot support member.

11. The apparatus of claim 10 including biasing members for lateral pivoting said left foot support platform and said right foot support platform about respective vertical pivot axis.

12. The apparatus of claim 11 including a lock pin for locking said left foot support platform and said right foot support platform to respective said left foot support member and said right foot support member.

13. The apparatus of claim 1 including left and right handlebars rotatably secured to said stanchion and left and right handlebar drivers secured to respective left and right handlebars and respective left and right foot support members.

* * * * *